United States Patent [19]

Rosenberg

[11] Patent Number: 4,648,851

[45] Date of Patent: Mar. 10, 1987

[54] STUFFED ANIMAL WITH CHANGEABLE FEATURES

[75] Inventor: Ruth Rosenberg, New Rochelle, N.Y.

[73] Assignee: Dena Smith-Migatz, New Rochelle, N.Y. ; a part interest

[21] Appl. No.: 762,578

[22] Filed: Aug. 5, 1985

[51] Int. Cl.[4] ..... A63H 3/02

[52] U.S. Cl. ..... 446/372; 446/369

[58] Field of Search ..... 446/372, 369, 321, 385, 446/387, 388, 391, 268, 337, 339, 370, 371, 100

[56] References Cited

U.S. PATENT DOCUMENTS

| | | | |
|---|---|---|---|
| 902,113 | 10/1908 | Ruple . | |
| 1,292,789 | 1/1919 | Jack | 446/369 |
| 1,442,761 | 1/1923 | Beach . | |
| 1,554,136 | 9/1925 | Shafer . | |
| 1,793,400 | 2/1931 | Herrmann . | |
| 2,274,303 | 2/1942 | Ornstein | 446/369 X |
| 2,433,555 | 12/1947 | Hulsz | 446/372 X |
| 2,997,810 | 8/1961 | Bellas . | |
| 3,125,826 | 3/1964 | Ostander . | |
| 3,977,121 | 8/1976 | Goldfarb et al. | 446/369 |
| 4,413,442 | 11/1983 | McSweeney . | |

*Primary Examiner*—Mickey Yu

*Attorney, Agent, or Firm*—Henry Sternberg; Bert J. Lewen

[57] ABSTRACT

A stuffed animal having an inner body covered by a loosely connected enlarged outer skin permitting adjustment of the folds therein for changing the appearance and/or expression of the stuffed animal by external manipulation.

10 Claims, 6 Drawing Figures

10
11
12a
13
21
21a
22
31
32
33
34
35
35a
36a
4
5
6

STUFFED ANIMAL WITH CHANGEABLE FEATURES

This invention relates to toys and more particularly to stuffed toys such as animals, dolls and similar objects which are intended to more or less represent the natural characteristics of their living counterparts.

It is a general object of the present invention to provide a novel and improved toy of the type described.

More particularly, it is an object of this invention to provide a novel and improved toy of the stuffed type and more particularly a stuffed animal toy, which shall be more nearly lifelike in appearance than those at present manufactured in the sense that it shall have the facility of being changeable in appearance, for example different facial expressions, merely by external manipulation.

Previously, stuffed toys, as for example stuffed animals, were made with an outer skin completely filled to the desired configuration with a stuffing material, usually to an extent where the outer skin was relatively taut.

Other stuffed toys are known, in which an outer skin is filled, more or less, with a granular material. Such toys are sometimes referred to as "bean bag" toys. In such toys the outer skin, while being loose, may undergo a change in shape as a result of redistributing the granular material to different portions of the toy by shifting the granular material from one such portion to another through external manipulation. This type of toy does not have a defined inner body. The shiftable granular material is itself the inner body.

It is, therefore, not possible, with the known toys, to maintain the general natural body characteristics of the living counterpart of the specific toy involved while permitting the user to change, at will, external features such as wrinkles in the skin. It will be seen that in accordance with the present invention, simple manipulation, particularly in the face region, permits alteration of the expression of the toy stuffed animal from happy, to sad, to alert, to sleeping, etc.

In accordance with the present invention, there is provided a stuffed toy, for example an animal, comprising a defined body having an outer surface, a flexible covering sheet overlying at least one portion of the outer surface and attachment means for attaching the covering sheet to the body at a plurality of spaced locations. The covering sheet has at least one portion thereof free of attachment to and overlying said one portion of said outer surface intermediate said spaced locations and said one portion of said covering sheet has a surface area which is greater than the surface of said one portion of said outer surface which it overlies. The attachment means cooperate with the covering sheet for forming wrinkles in said one portion thereof, and the covering sheet is of a material which has sufficient body to generally retain a new wrinkle-shape after being reshaped in response to external manipulation. As a result, the shape and location of the wrinkles in the covering sheet overlying said one portion can be changed so as to vary the appearance, for example the facial expression, of the stuffed animal.

In the accompanying drawings and following specification there is disclosed, by way of example only, a single embodiment of the present invention, with the understanding, however, that various and numerous changes may be made in the design, shape, arrangement, material and proportion of the various parts without departing from the spirit of the invention or the scope of the appended claims.

In the Drawings:

FIG. 3 is a partly transverse sectional view of the toy of FIG. 1 taken in the direction of the arrows 3—3 in FIG. 1;

Heretofore, in the construction of such stuffed toys, usually representing animals or people, it has been customary to construct a cover formed of several parts which are stitched together along their meeting edges, and the whole is then stuffed with some material such as saw dust, excelsior, or the like, the stuffing being forced in until it fills the covering quite tightly, resulting in a toy which assumes a shape which cannot be changed or altered materially, owing to the natural resilience and tight packing of the stuffing material.

The present invention contemplates the provision of a toy having a body made substantially in the manner described above but having an additional, i.e. outer, skin, covering the body, or at least covering substantial portions of the body. The outer skin is connected to the body (by attachment means, preferably stitches of thread) at only spaced locations therealong so as to be loose with respect to the body between such spaced locations. Excess outer skin material, hereinafter referred to as "skin", is provided between the spaced locations so that the skin may form wrinkles and folds and so that these wrinkles and folds may be adjusted and reshaped to different wrinkle and fold configurations in response to external manipulation thereof. The stuffed animal according to the present invention, therefore, having such capability, may have its skin manipulated, for example in the face region, so as to exhibit different facial expressions by rearrangement of the folds and thus of the wrinkles of the face.

Figure 1:
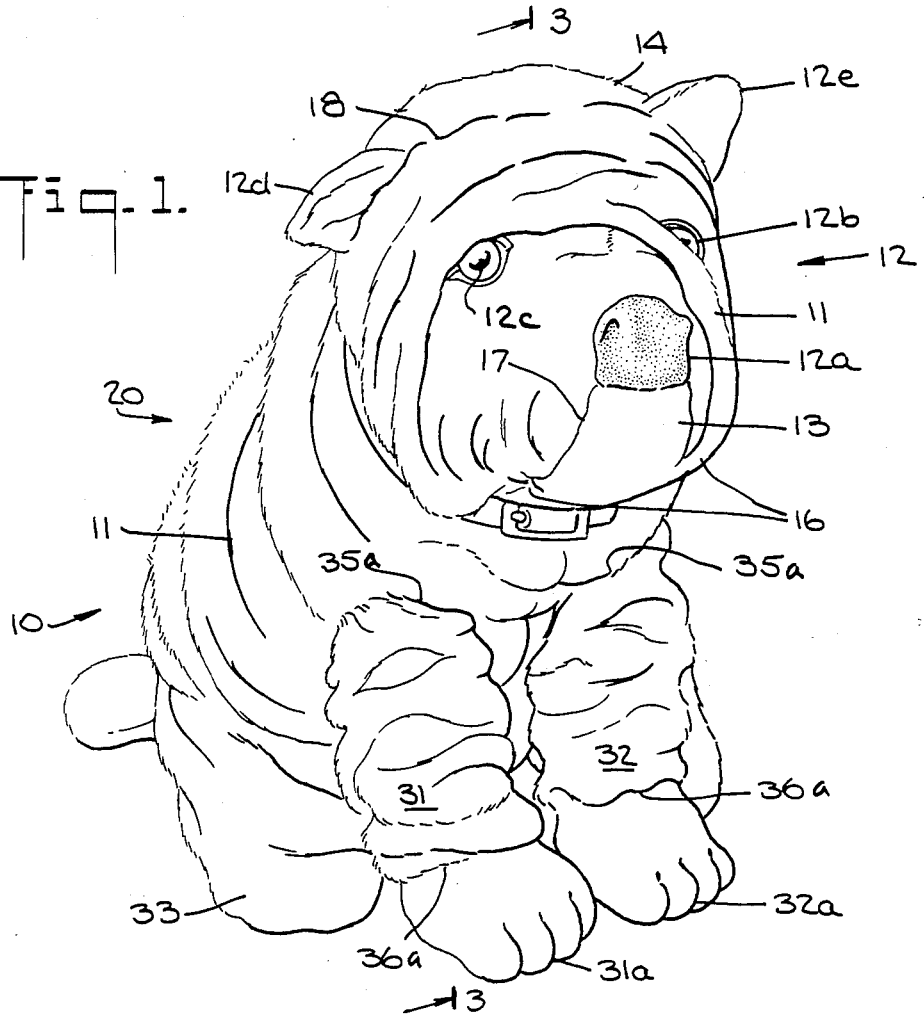
FIG. 1 is a perspective view of a complete toy constructed according to this invention and arranged in one of its possible poses.

For a better understanding of the invention, reference should be had to the drawings which disclose a preferred embodiment of the invention, here shown as a Shari-pey puppy dog, although, of course, other animals may be represented. FIG. 1 shows the finished toy in one of its numerous characteristic poses in which the snout portion of the puppy is relatively free of wrinkles and most of the skin has been pushed back to form substantial wrinkles around the eyes, partially covering one of the eyes and substantially covering the other one and having very deep wrinkles in the forehead and jowel portions of the head. By comparison, in the FIG. 2 condition, both eyes are substantially exposed and the wrinkles are more evenly distributed over the entire face, resulting in a toy having a substantially different facial expression.

Figure 2:
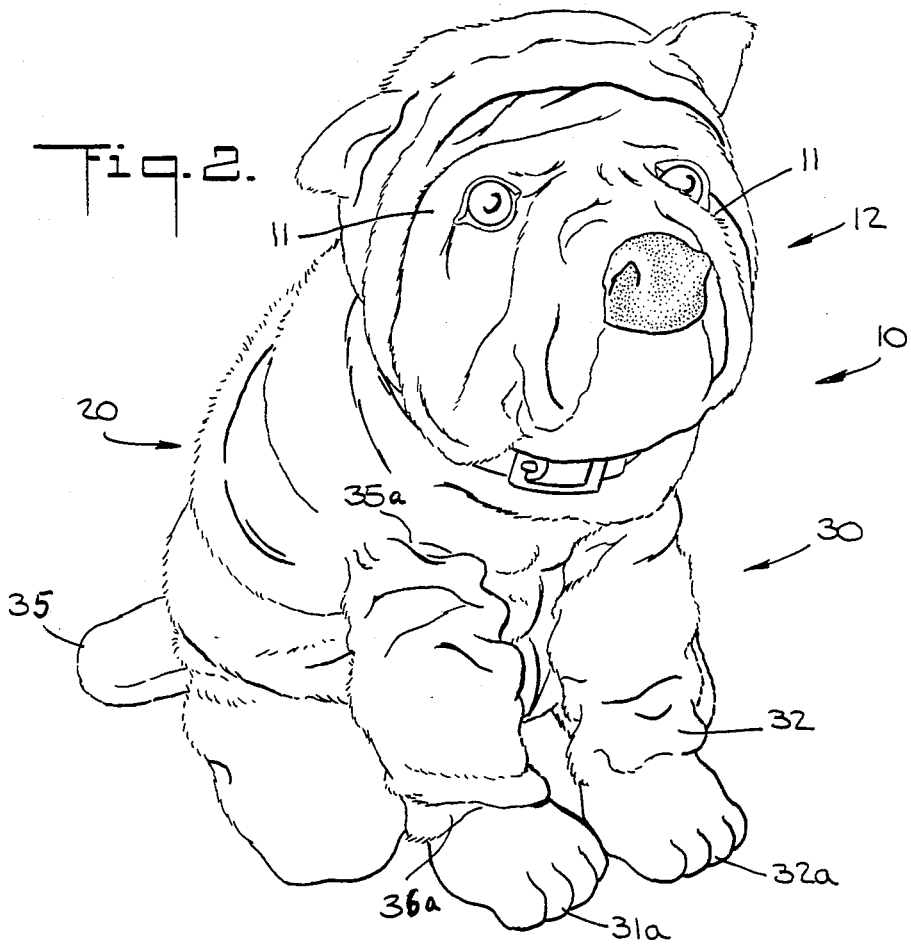
FIG. 2 is a perspective view of the toy, according to FIG. 1, arranged in another one of its possible poses.
Figure 5:
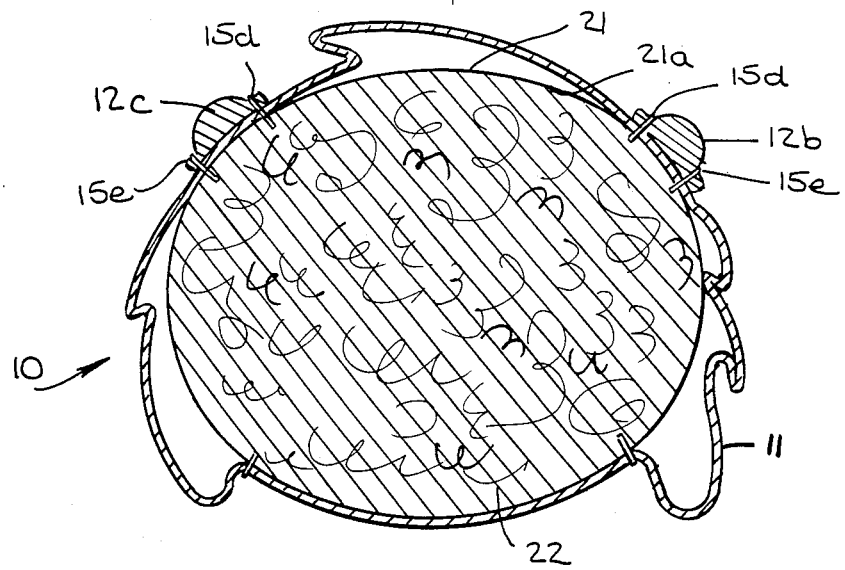
FIG. 5 is a transverse sectional view taken in the direction of the arrows 5—5 in FIG. 3.
Figures 5, 6:
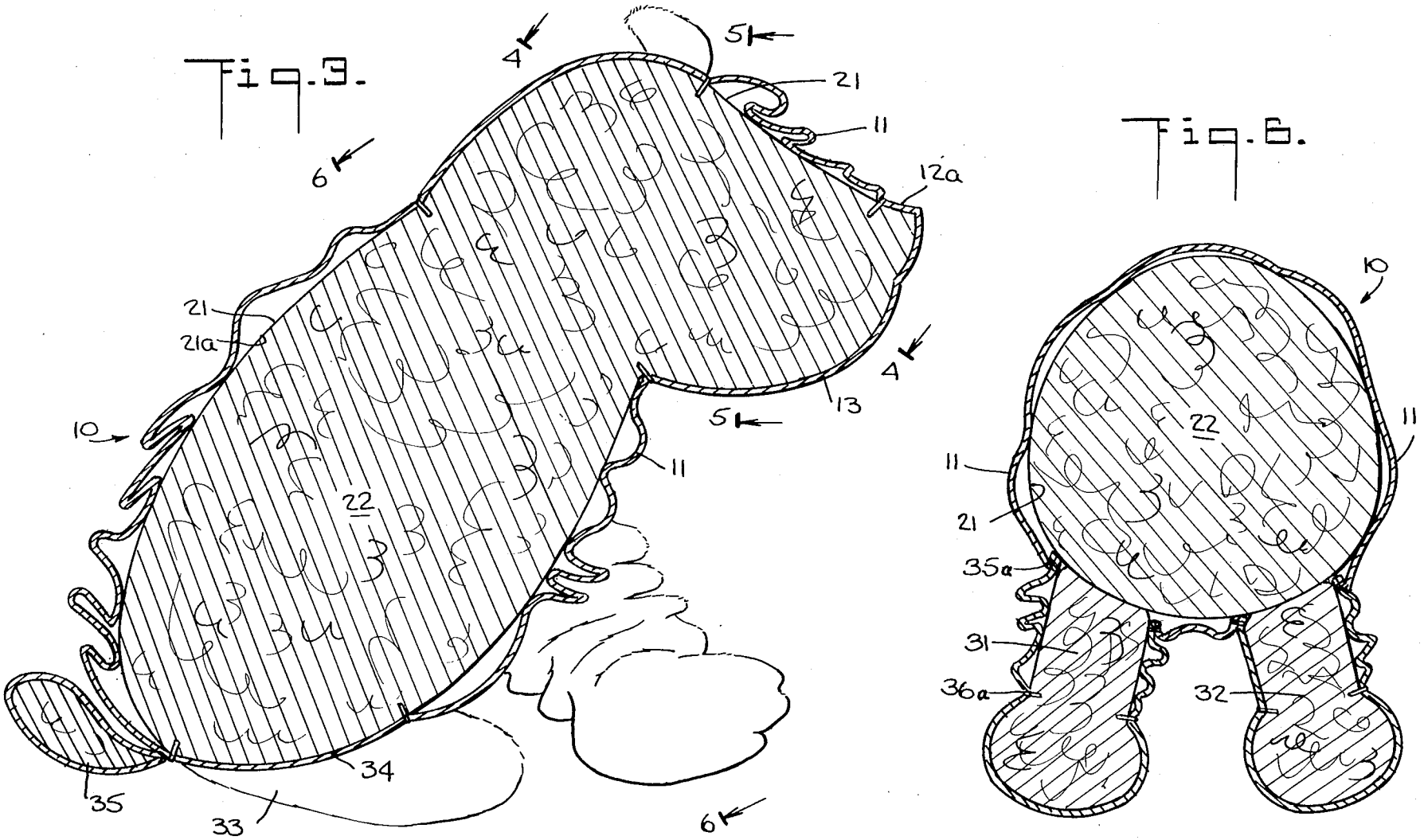
FIG. 6 is a transverse sectional view taken in the direction of the arrows 6—6 in FIG. 3.

The toy depicted in FIGS. 1 and 2, has a body 10 covered by an outer skin 11. The body 10 has a head portion 12, a torso portion 20, a leg portion 30, including a pair of front legs 31 and 32 having paws at the ends thereof.

The body 10 is defined by an outer surface designated by reference numeral 21 in FIGS. 3–6. This outer surface 21 is formed by a fabric 21*a*, several pieces of which are stitched together along their mating edges and then stuffed with a stuffing material 22. The fabric 21*a* is tightly filled by the stuffing material 22 such as, for example, saw dust or foam rubber pellets etc., being forced in until it tightly fills the sewn fabric 21*a* and forms the body 10, having a relatively taut outer body surface 21, for the entire animal. The body 10, having the aforesaid taut outer surface 21, is covered with an additional skin, i.e. the skin-like material 11 which is attached only at discrete, spaced, locations to the tautly covered inner body 10.

Thus, for example, the head portion 12 has a face portion having ears, eyes and a snout, all of which are fixed directly to the outer surface 21 of the head portion 12 and those locations therefore serve to anchor the skin-like material 11 to the outer body surface 21. Preferably, running from the snout along the chin region and down to the neck or collar region of the stuffed animal is a portion 13 in which the outer skin 11 is substantially tautly stretched over the corresponding outer surface 21 of the inner body portion of the head and is generally not free to move with respect thereto. Similarly, several other portions of the toy animal may have an outer skin relatively tautly attached to the outer surface 21. Thus, for example the scalp portion 14 of the head portion 12, the paw portions 31*a* and 32*a*, the hind leg 33, the belly portion 34 and the tail portion 35 are preferably covered with a skin 11 which is tightly stitched and taut with respect to the outer surface portions 21 of the regions of the body 10 which they overlie.

The material forming the skin 11 is preferably stitched or otherwise attached to the body surface 21 by thread stitches, such as stitches 15*a*, 15*b*, 15*c*, etc., including, of course, the stitching at the eye, ear, and snout portions. See, for example, FIG. 5 where stitches 15*d* and 15*e* are shown as anchoring the eyes 12*b* and 12*c* and at the same time anchoring the skin material 11 to the outer surface 21 of the face portion of the toy animal.

Figure 4:
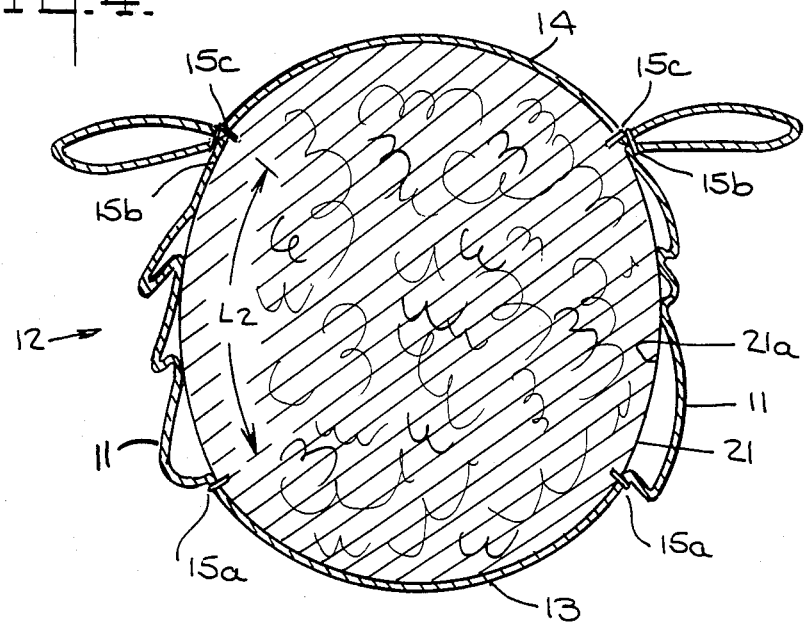
FIG. 4 is a transverse sectional view of the head portion of the stuffed toy animal, according to the present invention, taken in the direction of the arrows 4—4 in FIG. 3.

It is to be understood that the skin 11 is not attached to the outer surface 21 of the body in the regions between adjacent ones of the spaced connection points, for example, the regions between stitches 15*a* and 15*b* in FIG. 4. Thus, as may be seen in FIG. 4, the material of the skin 11, attached to the head portion 12 at the spaced connections 15*a* and 15*b*, for example, is loose with respect to the outer surface 21 along the entire distance intermediate the stitches 15*a* and 15*b*. Furthermore, it will be seen that the skin 11 is substantially larger, i.e. longer in length as measured between, for example, connecting points 15*a* and 15*b*, than a similar measurement taken directly along the taut outer surface 21 of the corresponding underlying surface portion of body 10. Thus, the length $L_1$ of the material of the skin 11, between the stitches 15*a* and 15*b*, is greater than the distance $L_2$, measured along the surface 21 of the body portion between the same stitches 15*a* and 15*b*. Consequently, also the surface area of the skin 11 in the region between adjacent seams, for example the seams defined by reference numerals 35 and 36 in FIG. 1, is greater than the area of the body outer surface 21, which is bounded by said seams and unlerlies the skin portion in question. Of course, the stitches, such as stitches 15*a*, for example, represent seams or a plurality of successive stitches extending substantially from the region of the snout 12*a* to the throat region of the stuffed animal as, for example, along the line 17 in FIG. 1. Preferably, the skin material is stitched in "gathered" form along the seam line 17 so as to account for the extra material of the skin and to form some inherent wrinkles therein. The location of the stitching as shown, the supple characteristics of the material, the added amount of material between the respective seams, such as seams 15*a* and 15*b*, and the "gathering" of the material of the skin 11 along the seam 17, result in forming of the skin into wrinkled configuration, as shown in the drawings. In the preferred embodiment, the material is gathered together at the ends of the loose fitting portions such as, for example, in the regions 16 forming the jowls of the head portion, i.e. where the skin 11 which forms the loose fitting part of the face skin is seamed (seam 17) with, i.e. connected to, the portion 13 which forms a tight fitting part of the face skin. The portion of the skin 11 which forms the face is thus attached to the body at its perimeter by seams such as seams 17 and 18 and is additionally attached to the body at interior locations, for example, the eyes 12*b*, 12*c*. Further away from a seam, such as the seam 17, for example, the skin 11, being loose, can be readily manipulated by the user into a variety of wrinkle configurations such as exemplified by the two configurations shown in FIGS. 1 and 2, respectively.

The legs 31 and 32, have an inner, tightly filled body portion surrounded by a generally cylindrical sleeve-shaped skin portion stitched to the body at the juncture with the paw portions 31*a* and 32*a*, respectively. The opposite ends of the sleeve-shaped skin portions are stitched to the torso along seams 35, 36, respectively. The axial length of each of the sleeve-shaped skin portions covering the legs 31, 32 is substantially greater than the axial length of the legs themselves so that many fold lines or wrinkles naturally occur in this region such as, for example, seen in FIG. 1. By external manipulation these wrinkles can be adjusted into the FIG. 2, or any intermediate configuration desired. There is preferably no connection between the sleeve-like skin portion of skin 11 covering the legs and the inner body of the legs intermediate the seams 35 and 36 connecting the sleeve-like portions to the torso and to the paw regions 31*a* and 32*a*, respectively.

While several different sheet materials can be satisfactorily used for the skin material 11, one fabric which displays the characteristics desirable for providing good retention of changed wrinkle shape, in response to external manipulation, is the material known as "Designer Velvet" manufactured by the American Textiles Company, as their "Number AT8280 Collins".

It will, of course, be understood that while the toy illustrated is in the form of a dog with certain wrinkle characteristics, various other toy dolls or animals and various other wrinkle configurations are intended to be within the scope of this invention and, therefore, the invention is not to be limited to the particular toy illustrated.

Having thus described the invention, what is claimed as new and desired to be secured by Letters Patent is:

1. A stuffed animal comprising: a body including a face portion having an outer surface, a flexible covering sheet overlying at least one portion of said outer surface, and attachment means for attaching said covering sheet to said face portion at a plurality of spaced locations, said covering sheet having at least one portion thereof free of attachment to and overlying said one portion of said outer surface intermediate said spaced locations and said one portion of said covering sheet having a surface area which is greater than the surface area of said one portion of said outer surface which it overlies, said attachment means cooperating with said covering sheet for forming wrinkles in said one portion thereof, and said covering sheet being of a material having sufficient body to generally retain a new wrinkle-shape after being reshaped in response to direct external manipulation applied solely to the exterior surface of said covering sheet, whereby the shape and location of the wrinkles in said covering sheet overlying said one portion can be changed so as to vary the appearance of the stuffed animal.

2. A stuffed animal according to claim 1, wherein said attachment means attach said covering sheet to said outer surface at the perimeter of said one portion of said outer surface and at least at one location interior of and spaced from said perimeter.

3. A stuffed animal according to claim 1, wherein said spaced locations coincide with the eyes, nose and mouth of the face and with locations at substantially the perimeter of said one portion.

4. A stuffed animal according to claim 1, wherein said face portion comprises at least one additional surface portion and said covering sheet comprises a portion coverinq said additional surface portion, without any substantial freedom of movement therebetween.

5. A stuffed animal according to claim 1, wherein said body includes a head portion and a torso portion, each including a first surface portion which is loosely covered by said covering sheet and a second surface portion which is tightly covered by said covering sheet, and whereon only said loosely covered portions exhibit wrinkles whose shape is capable of being changed by external manipulation.

6. A stuffed animal according to claim 1, wherein said body, in its entirety, is covered with said covering sheet, said body having at least one other surface portion which is only loosely covered by said covering sheet and where the latter is substantially free to form variable wrinkles.

7. A stuffed animal according to claim 1, wherein said body includes a torso and leg portions and said leg portions each compromises a surface portion with a loose covering sheet adapted to form substantially peripherally extending wrinkles therealong.

8. A stuffed animal according to claim 1, further comprising a pair of eye members fixed to said one portion of said outer surface for securing said otherwise loose covering sheet to said one portion of said outer surfaces at a pair of specific locations thereof, said covering sheet remaining freely shiftable with respect to said one portion of said outer surface at regions thereof surrounding said eye members.

9. A stuffed animal resembling a real animal, comprising:

a body having an outer surface, a flexible covering sheet means overlying at least one portion of said outer surface, said flexible covering sheet means adapted to simulate the skin of the real animal represented by the stuffed animal, and attachment means for attaching said covering sheet means to said body at a plurality of spaced locations, said covering sheet means having at least one portion thereof free of attachment to and overlying said one portion of said outer surface intermediate said spaced locations and said one portion of said covering sheet means having a surface area which is greater than the surface area of said one portion of said outer surface which it overlies, said attachment means cooperating with said covering sheet means for forming wrinkles in said one portion thereof, and said covering sheet means being of a material having sufficient body to generally retain a new wrinkle-shape after being reshaped in response to direct external manipulation applied solely to the exterior surface of said covering sheet means, whereby the shape and location of the wrinkles in said covering sheet means overlying said one portion of said outer surface can be changed so as to substantially vary the appearance of the stuffed animal, said covering sheet means covering said body in its entirety and having at least one other surface portion which is only loosely covered by said covering sheet means and where the latter is substantially free to form variable wrinkles.

10. A stuffed animal resembling a real animal, comprising:

a body having an outer surface, a flexible covering sheet means overlying at least one portion of said outer surface, said flexible covering sheet means adapted to simulate the skin of the real animal represented by the stuffed animal, and attachment means for attaching said covering sheet means to said body at a plurality of spaced locations, said covering sheet means having at least one portion thereof free of attachment to and overlying said one portion of said outer surface intermediate said spaced locations and said one portion of said covering sheet means having a surface area which is greater than the surface area of said one portion of said outer surface which it overlies, said attachment means cooperating with said covering sheet means for forming wrinkles in said one portion thereof, and said covering sheet means being of a material having sufficient body to generally retain a new wrinkle-shape after being reshaped in response to direct external manipulation applied solely to the exterior surface of said covering sheet means, whereby the shape and locations of the wrinkles in said covering sheet means overlying said one portion can be changed so as to substantially vary the appearance of the stuffed animal, said attachment means attach said covering sheet means to said outer surface at the perimeter of said one portion of said outer surface and at least one location interior of and spaced from said perimeter.

* * * * *